US005236381A

United States Patent [19]

Keogh

[11] Patent Number: 5,236,381

[45] Date of Patent: Aug. 17, 1993

[54] MANUALLY POWERED WATER SKIS

[76] Inventor: John Keogh, P.O. Box 2994, Grand Junction, Colo. 81502

[21] Appl. No.: 931,779

[22] Filed: Aug. 17, 1992

[51] Int. Cl.[5] ..... A63C 15/03

[52] U.S. Cl. ..... 441/77

[58] Field of Search ..... 441/65, 66, 74, 75, 441/76, 77, 78; 280/611, 613, 614, 615

[56] References Cited

U.S. PATENT DOCUMENTS

| | | | |
|---|---|---|---|
| 2,260,057 | 10/1941 | Rydberg | 280/611 |
| 2,482,074 | 9/1949 | Stephens | 441/77 |
| 2,950,118 | 8/1960 | Sharpe | 280/611 |
| 3,031,696 | 5/1962 | Brabb | 441/77 |
| 3,112,504 | 12/1963 | Carlton | 441/77 |
| 3,750,202 | 8/1973 | Ceccato | 9/310 D |
| 3,775,866 | 12/1973 | Marker | 280/613 |
| 3,784,216 | 1/1974 | Maier, Jr. | 280/611 |
| 4,599,072 | 7/1986 | Pollini et al. | 441/65 |
| 4,618,329 | 10/1986 | Celez | 441/76 |
| 4,846,743 | 7/1989 | Ping | 441/77 |
| 4,915,659 | 4/1990 | Sanders | 441/76 |
| 4,952,184 | 8/1990 | Graziano | 441/77 |
| 4,985,006 | 1/1991 | Brunet | 441/76 |

*Primary Examiner*—Jesus D. Sotelo
*Assistant Examiner*—Stephen P. Avila

[57] ABSTRACT

Equipment for movement upon the surface of water comprised of two stiff buoyant skis to support the user. Thrust is provided by one or more fins affixed to the bottom of the skis, the fins being affixed by an articulated joint so as to provide more resistance in one direction than in the other. The means for receiving the users feet are formed of two portions, the rear portion being demountably adjustable, the front portion being connected to the ski by a mechanical joint.

3 Claims, 3 Drawing Sheets

MANUALLY POWERED WATER SKIS

Background

1. Field of Invention

This invention relates to aquatic recreational devices which enable manually powered aquatic skiing.

2. Description of Prior Art

Manually powered equipment for skiing on the surface of water has been previously described. Examples of relevant prior art are U.S. Pat. No. 4,618,329 to Celez, U.S. Pat. No. 4,599,072 to Pollini et al, and U.S. Pat. No. 4,915,659 to Sanders. Each have shortcomings that the present invention overcomes. U.S. Pat. No. 4,618,329 to Celez describes a non-articulated fin, which would give less thrust than the articulated fins presented herein. U.S. Pat. No. 4,599,072 to Pollini et al has the disadvantage of requiring a paddle for thrust. U.S. Pat. No. 4,915,659 to Sanders has the disadvantage of having rubber cups on the bottom which would be less resistant to wear and have a poor mating to the bottom when the ski is moved forwards through the water. No invention previously described has anticipated my use of a planar fin, which is attached to the ski by a borne cylinder, for the purpose of imparting thrust, or a foot receiving means consisting of a hinged front portion and a demountably adjustable rear portion.

OBJECTS AND ADVANTAGES

Accordingly, beside the objects and advantages already described, several objects and advantages of the present invention are:

(a) to provide a means of rapid motion across the surface of a body of water;

(b) to provide a means of aquatic recreation wherein no motor is required;

(c) to produce an article of transport that is readily manufactured and non polluting; and (d) to produce a means of aquatic transport that is safe to use and is readily repairable;

Additional objects and advantages will become apparent from a consideration of the accompanying drawings and descriptions.

DRAWING FIGURES

The advantages of the invention will become more apparent from the accompanying drawing which are described below:

REFERENCE NUMERALS IN DRAWINGS

1 ski

2 fin

3 slot in the borne cylinder

Figure 1:
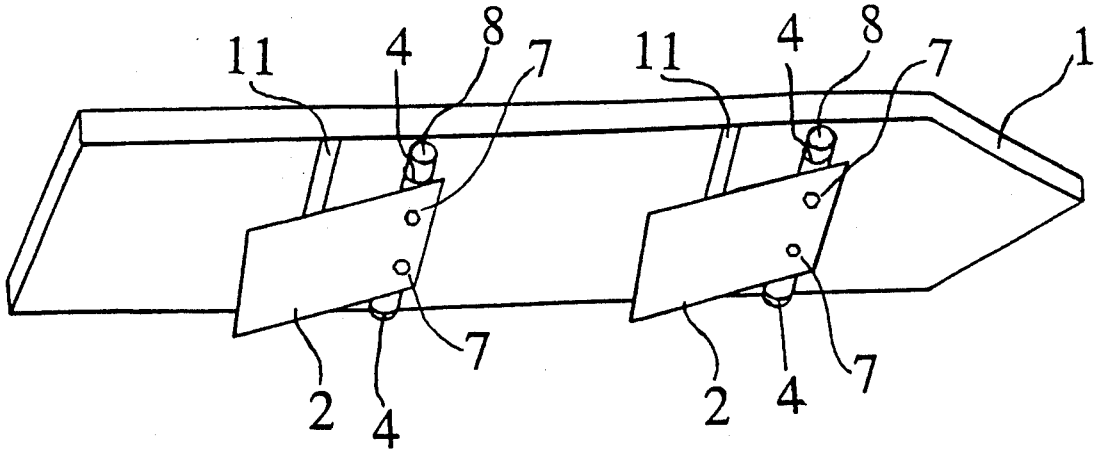
FIG. 1 is a bottom elevational view of a ski including the thrust means.

4 U-shaped bearing to support the borne cylinder

5 groove in the borne cylinder

6 bolt to attach the fin to the borne cylinder

7 nut to secure the bolt which attaches the fin to the borne cylinder

8 borne cylinder

9 indentation in the ski

10 stop to keep the fin at 90 degrees with respect to the bottom of the ski

11 stop to keep the fin off the bottom of the ski

12 hinge for the front portion of the foot receiving means

13 support for the hinge

14 platform for the front portion of the foot receiving means

15 flexible upper of the front portion of the foot receiving means

16 eyelets in the rear portion of the foot receiving means

17 laces for the rear portion of the foot receiving means

18 rear portion of the foot receiving means

19 non-skid material

20 knob on the fin for a tether to be attached to

21 knob on the ski for a tether to be attached to

22 tether

23 hole in the borne cylinder

DESCRIPTION—FIGS. 1-9

Figure 2:
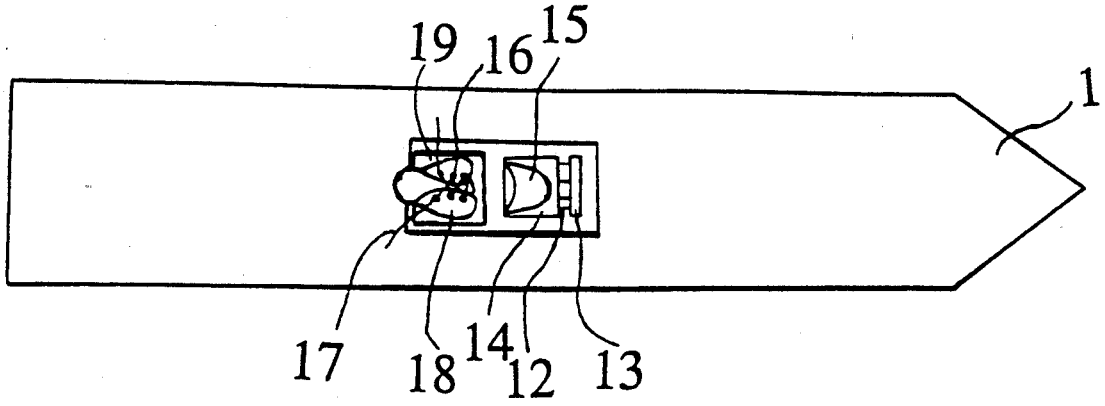
FIG. 2 is a top view of a ski.
Figure 3:
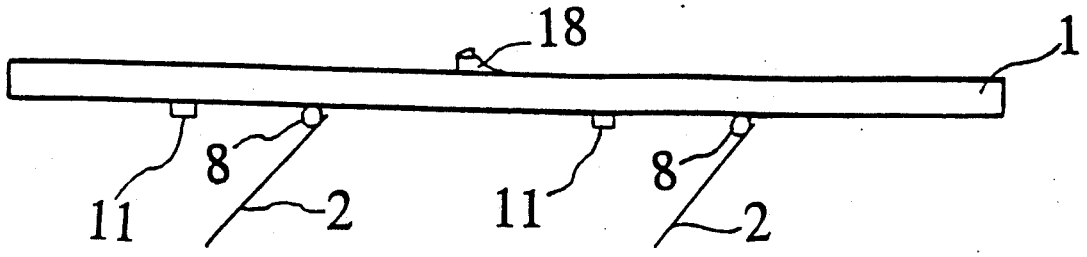
FIG. 3 is a side view of a ski.

A typical embodiment of the device is shown in FIG. 1 (bottom elevational view) FIG. 2 (top view) and FIG. 3 (side view). The ski 1 is of a rigid buoyant material so as to displace sufficient water to support both its own weight and the weight of a user, and is of a generally streamlined shape having a flat top with an indentation 9 in the center and a flat bottom. The thrust fins assemblies would be placed singly or multiply on the bottom of the ski of each ski.

The thrust fin assembly, which is shown in FIGS. 1, 3, 7, 8, and 9, has three different embodiments presented herein. The common features of the embodiments are a thrust fin 2, a borne cylinder 8, U-shaped bearings 4, a nut 7 which holds said fin 2 to a borne cylinder 8, and a bolt 6. A U-shaped bearings 4 acts as a bearing means with regard to the borne cylinder 8, riding within grooves 5 thereon, and acts as a means to attaching the borne cylinder 8 to the ski 1. The U-shaped bearings 4 may be secured to the ski 1 by any suitable mounting means. The fin may be made of sheet metal, rigid plastic, or other rigid and durable material.

Figure 4:
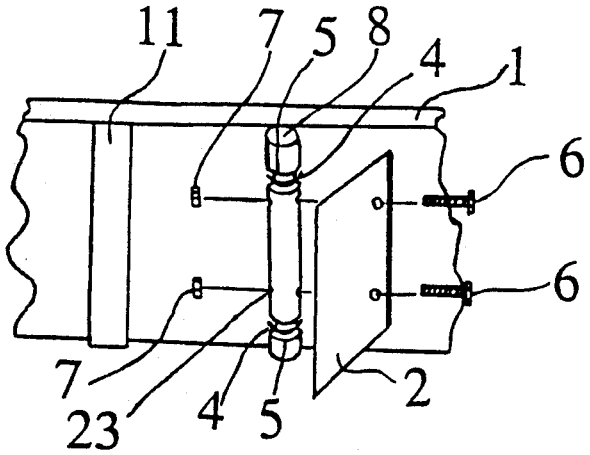
FIG. 4 is an exploded, detailed view of a fin assembly.

In the embodiment of the thrust assembly represented in FIG. 4 a fin 2 is attached to the front of the borne cylinder 8 by means of a bolt 6 and nut 7. An edge of said fin 2 comes into contact with the bottom of the ski 1 when the ski is moved backwards through water, arresting the fin 2 at 90 degrees with respect to the bottom of the ski. It is obvious that the degree at which the motion of this fin is arrested may be varied by changing where the fin is attached to the borne cylinder 8, changing the shape of the fin 2 and by other means. A stop 22 may be supplied to keep the fin 2 from becoming completely flush with the ski 1 on the forward stroke, thus facilitating filling of the fin 2 with water when the ski 1 is moved backwards through the water. Alternately, the fin 2 may be allowed to fall by its own weight if it is denser than the medium in which it is operating.

The use herein of U-shaped bearings as a bearing means is intended to be representative. There are a variety of obvious substitute bearing means such as a larger cylinder bonded to the bottom of the ski acting as a bearing means or a narrower cylinder, which is anchored at both ends being inserted through the borne cylinder and acting to bear said borne cylinder.

Figure 5:
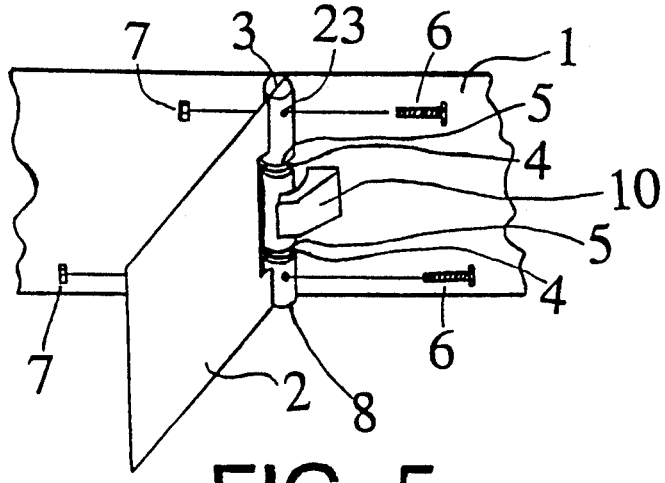
FIG. 5 is a view of an alternative embodiment of a fin assembly.

An alternate embodiment, which is represented in FIG. 5, shows the fin 2 inserted in a slot 3 in the borne cylinder. A bolt 6 is inserted through the borne cylinder 8, slot 3, and fin 2, thereby supporting the fin 2 and keeping it in correct relation to the borne cylinder 8. In this embodiment the fin 2 is stopped in the upright position by a stop 20, rather than by its bottom portion coming into contact with the bottom of the ski 1 as in the embodiment represented in FIG. 4. In other respects it is like the embodiment above.

Figure 6:
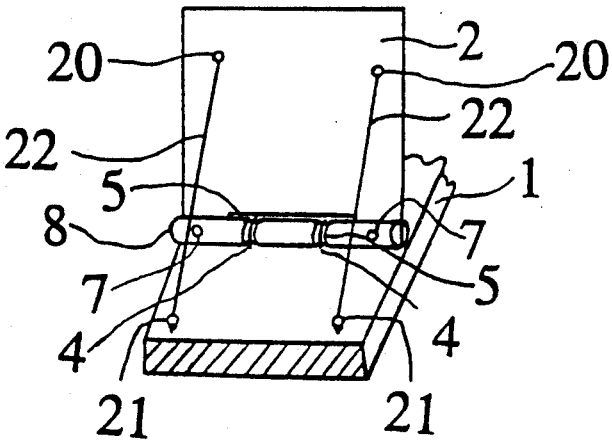
FIG. 6 is a view of an alternative embodiment of a fin assembly.
Figure 7:
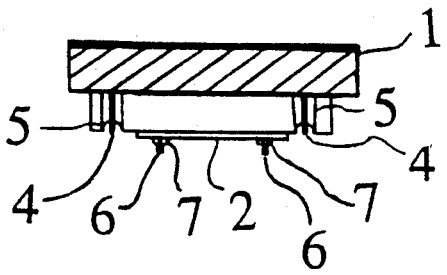
FIG. 7 is a cross-sectional view showing the foot receiving means.

A third embodiment of the thrust assembly is shown in FIG. 6. In this embodiment the fin 2 may be attached to the front of the borne cylinder 8, or inserted into a slot 3 in the borne cylinder as shown. The means of stopping the fin 2 to permit more drag on the backstroke is a pair of tethers 22. Tethers 22 have the advantage of permitting a gradual slowing of the fin 2 as it approaches 90 degrees. It is obvious that the tethers could be employed along with the embodiments of the thrust assembly shown in FIGS. 7 and 8. In other respects this embodiment is similar to the two previously described embodiments.

Figure 9:
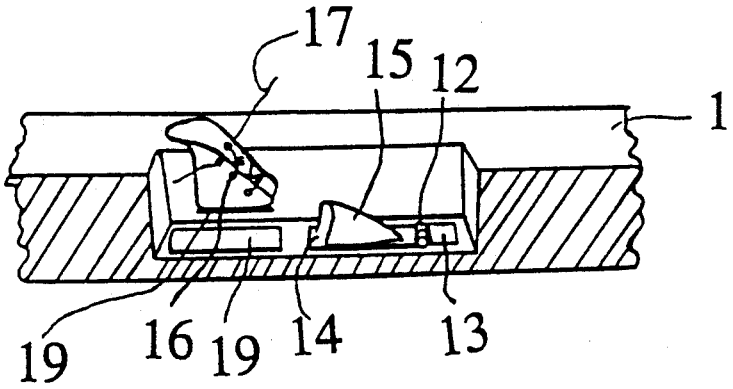
FIG. 9 is a front view of a fin.

The foot receiving means is shown in FIGS. 2 and 9. The foot receiving means is composed of two portions. The front portion is comprised of a flexible upper 15 attached to a rigid platform 14. The platform 14 is in turn attached by a hinged means 12 which is attached to a support 13. Said support is attached to the ski 1 at the bottom of the indentation in the ski 9. The hinged means 12 facilitates easy dismount in case of user upset on the surface of the water. The rear portion of the foot receiving means 18 is of a semi rigid or flexible material shaped to accommodate the rear portion of a users foot. Eyelets 16 and laces 17 are used to fasten the rear portion of the foot receiving means 18 to the foot of a user. The bottom of the rear portion of the foot receiving means is equipped with a layer of non-skid material 19 which mates with a similar layer on the bottom of the indentation in the ski 9. The user's feet, after being tied into the rear portion of the foot receiving means 18, may be slipped into said front portion of the foot receiving means, and then lowered to the bottom of the indentation. The rear portion will be kept in place through frictional contact between the two layers of non-skid material 19. The advantages of this arrangement are that the foot receiving means are immediately adjustable to a wide variety of foot sizes, easy dismount in case of user upset, and the rear portion of the foot receiving means will not be lost in an upset.

OPERATION—FIGS. 8, 9, 10

Figure 8:
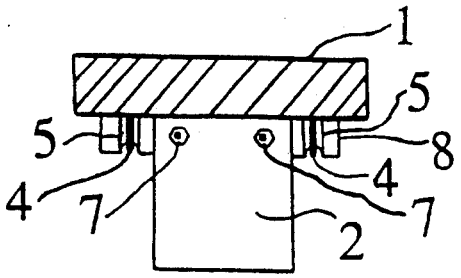
FIG. 8 is a front view of a fin.

FIGS. 8 and 9 show the fin 2 in the lowered state and the raised state, respectively. The fin would be lowered, as in FIG. 8, when the ski was moved backwards through the water, this would lower the drag of the ski as a whole. FIG. 9 shows the fin in its upright position which would result when the ski was moved forward through the water. Note that the top edge of the fin 2 would rest on the bottom of the ski when the fin is in the upright position. The alternative embodiments of the fin assembly presented previously would operate in a similar manner, although they would be stopped in the upright position by a stop, as in FIG. 5, or tethers, as in FIG. 6.

Figure 10:
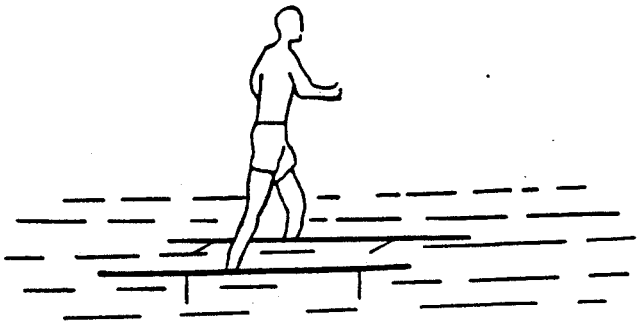
FIG. 10 is a view of the invention is use.

A pair of skis would be moved alternately back and forth through the water as shown in FIG. 10. Thrust would be derived from the increased resistance of the fins as they folded out when the ski is moved backwards through the water. The user would be supported upright out of the water as shown.

What is claimed is:

1. A pair of water skis each comprising; a streamlined body having a top surface and a bottom surface; said streamlined body having an indentation in the top surface within which is a means to receive a user foot; said foot receiving means being comprised of a rear portion and a front portion; said front portion of said foot receiving means being affixed to the ski, within the indentation in the ski, by an articulated joint; said front portion of said foot receiving means being so shaped as to encompass the front half of a foot; said rear portion of said foot receiving means being independent of both said ski and said front portion of said foot receiving means; said rear portion of said foot receiving means being formed so as to fit the rear portion of a users foot; said rear portion of said foot receiving means being attached to the foot of a user, during use of said ski, by buckles or laces; and said rear portion of said foot receiving means being held in place during use by friction between a non-skid material affixed to the bottom thereof and a complementary non-skid material affixed within said indentation in said ski; said water skis further having means for imparting thrust; said means for imparting thrust being in the form of one or more fin assemblies attached to the bottom of said ski; said fin assemblies being comprised of a fin, a borne cylinder to which said fin is attached by bonding, and a bearing means to antifrictionally hold said borne cylinder to the bottom of said ski; said fin assemblies further comprising a means to stop said fin when said fin is in a position to derive thrust from water resistance.

2. A water ski according to claim 1, further comprising said stop means being attached to the bottom of said ski.

3. A water ski as in claim 1, further comprising said stop means being a pair of tethers to stop said fins in said fin assemblies in a position where thrust may be derived from water resistance; said tethers having two ends; and said tethers being attached at one end to said ski and at the other end to said fin.

* * * * *